US007968781B1

(12) United States Patent
Luo

(10) Patent No.: US 7,968,781 B1
(45) Date of Patent: Jun. 28, 2011

(54) RESILIENT DEVICE FOR A DRUM PEDAL

(75) Inventor: Ying-Chin Luo, Lu Chou (TW)

(73) Assignee: K.H.S. Musical Instrument Co., Ltd., TAipei Hsien (TW)

( * ) Notice: Subject to any disclaimer, the term of this patent is extended or adjusted under 35 U.S.C. 154(b) by 0 days.

(21) Appl. No.: 12/653,485

(22) Filed: Dec. 15, 2009

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 7,301,088 B2 * 11/2007 Chen ..... 84/422.1

* cited by examiner

*Primary Examiner* — Kimberly R Lockett
(74) *Attorney, Agent, or Firm* — William E. Pelton; Cooper & Dunham LLP

(57) ABSTRACT

A resilient device for a drum pedal has a resilient member, an upper driven fastener, a lower driven fastener, a stationary fastener, an upper bearing, a connecting fastener and a lower bearing. The resilient member is connected between the upper and lower driven fasteners. The stationary fastener is connected pivotally to the upper driven fastener. The upper bearing is clamped between the stationary fastener and the upper driven fastener. The connecting fastener is connected pivotally to the lower driven fastener. The lower bearing is clamped between the connecting fastener and the lower driven fastener. The upper and lower bearings provide a reduction in friction between the elements so stepping on the pedal is easier and smoother and gives greater control.

6 Claims, 7 Drawing Sheets

RESILIENT DEVICE FOR A DRUM PEDAL

BACKGROUND OF THE INVENTION

1. Field of the Invention

The present invention relates to a resilient device, and more particularly to a resilient device for a drum pedal and having two bearings for smooth operation of the drum pedal.

2. Description of the Prior Arts

A drum pedal is used to beat against a bass drum sound the bass drum. With reference to FIG. 7, a conventional drum pedal (80) comprises a base (81), a pedal body (82), two stands (83), a driving shaft (84), a connecting seat (85), a drumstick (86), two resilient devices (87) and a chain (88).

The pedal body (82) is mounted pivotally to the base (81) and has a moving end. The stands (83) are separately mounted on the base (81) and are parallel to each other and each stand (83) has a top end and a bottom end. The driving shaft (84) is mounted pivotally between the top ends of the stands (83) and has two ends separately protruding out of the stands (83). The connecting seat (85) is mounted on the driving shaft (84). The drumstick (86) is attached to the connecting seat (85). The resilient devices (87) are separately attached to sides of the stands (83) and each resilient device (87) includes a stationary fastener (871), a driven fastener (872) and a spring (873). The stationary fastener (871) is mounted on the end of the driving shaft (84). The driven fastener (872) is connected pivotally to the stationary fastener (871). The spring (873) is mounted between the driven fastener (872) and the bottom end of the stand (83) and has a bottom end. The chain (88) is connected between the moving end of the pedal body (82) and the connecting seat (85).

When the pedal body (82) is stepped on, the driving shaft (84) is driven by the chain (88) to pivot. The pivotal movement of the driving shaft (84) thus drives the connecting seat (85), the drumstick (86) and the stationary fastener (871) to pivot as well and the drumstick (86) to beat the base drum. Meanwhile, the driven fastener (872) is driven to pivot and the spring (873) is stretched to store a recoil force. When the pedal body (82) is released, the spring (873) provides the recoil force to drive the drumstick (86) away from the base drum and to return to an original position automatically. Because the pedal body (82) and the drumstick (86) move synchronously, the base drum is conveniently actuated by stepping on the pedal.

To reduce friction, a bearing is securely mounted between the stationary fastener (871) and the driven fastener (872). The bearing allows the stationary fastener (871) and the driven fastener (872) to pivot smoothly and benefits transmission of the recoil force and stepping on the pedal body (82). However, the bottom end of the spring (873) is connected to the bottom end of the stand (83) and can not oscillate, so the friction between the bottom end of the spring (873) and the stand (83) requires more input when stepping on the pedal body (82).

To overcome the shortcomings, the present invention provides a resilient device for a drum pedal to mitigate or obviate the aforementioned problems.

SUMMARY OF THE INVENTION

The main object of the present invention is to provide a resilient device for a drum pedal having two bearings to reduce friction efficiently and improve quality in use.

A resilient device for a drum pedal comprises a resilient member, an upper driven fastener, a lower driven fastener, a stationary fastener, an upper bearing, a connecting fastener and a lower bearing. The resilient member is connected between the upper and lower driven fasteners. The stationary fastener is connected pivotally to the upper driven fastener. The upper bearing is clamped between the stationary fastener and the upper driven fastener. The connecting fastener is connected pivotally to the lower driven fastener. The lower bearing is clamped between the connecting fastener and the lower driven fastener. The upper and lower bearings provide a reduction in friction between the elements so stepping on the pedal is easier and smoother and gives greater control.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
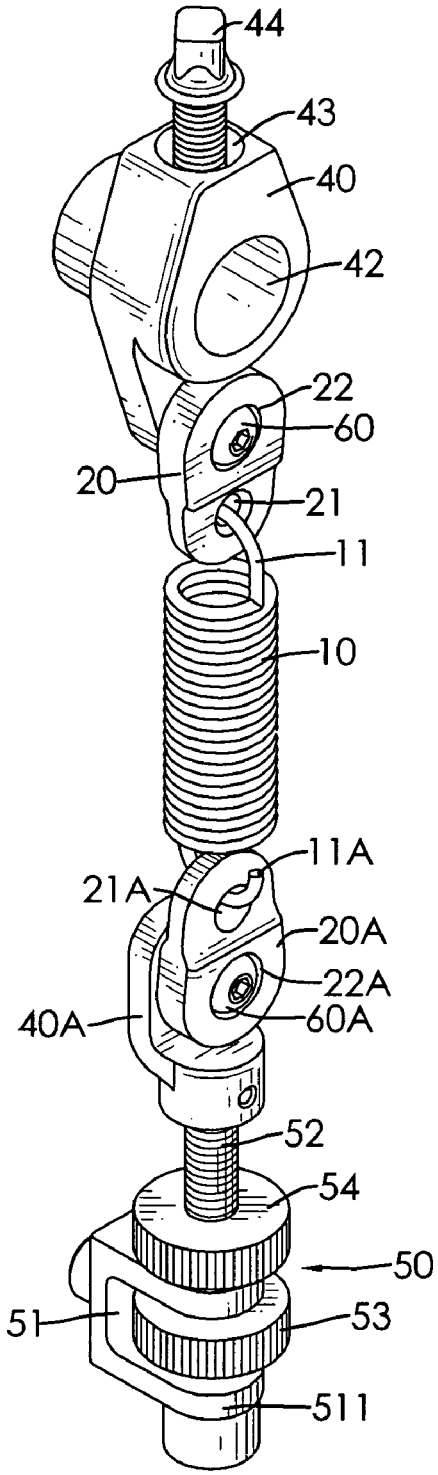
FIG. 1 is a perspective view of a resilient device for a drum pedal in accordance with the present invention.
Figure 2:
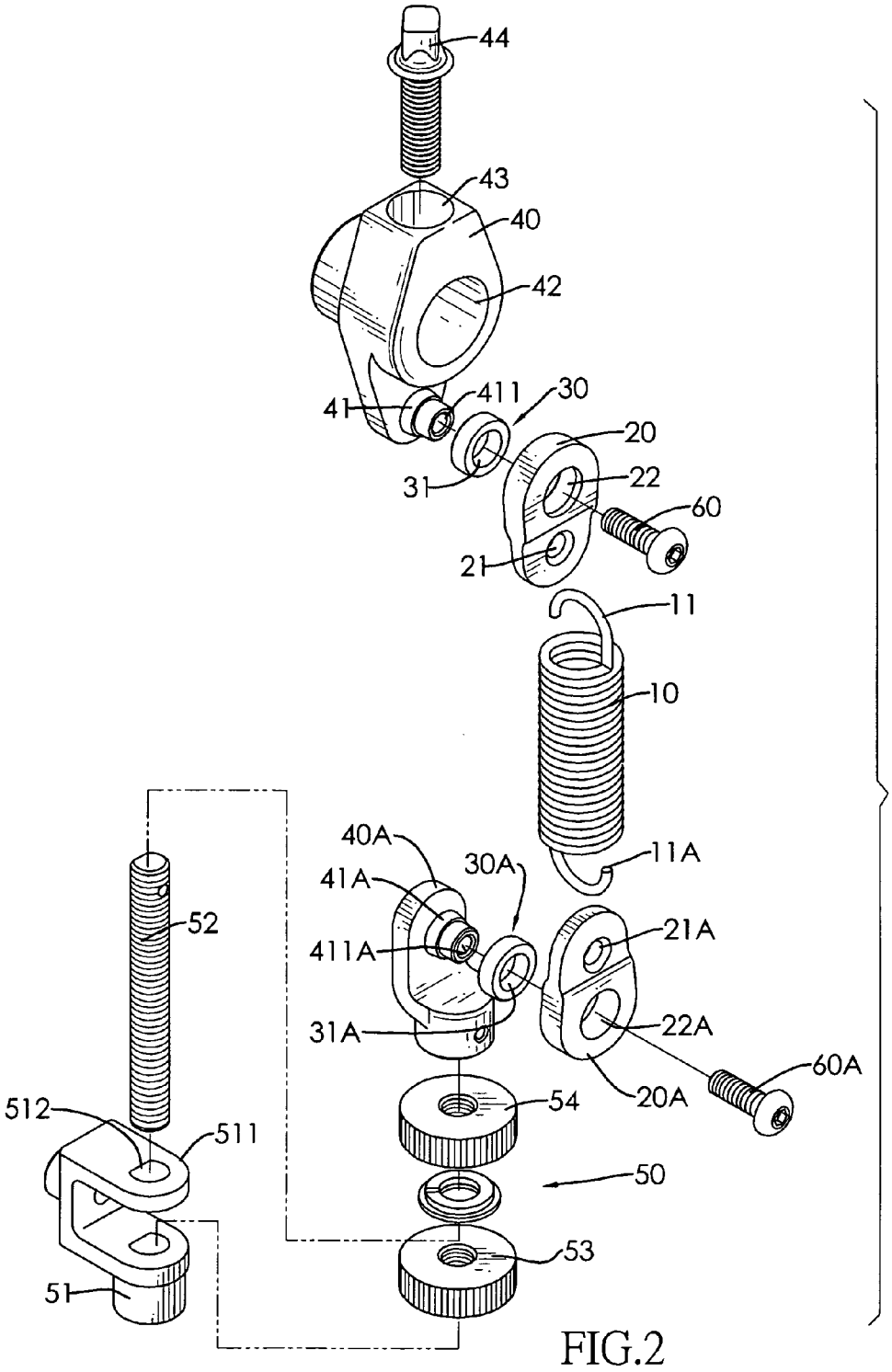
FIG. 2 is an exploded perspective view of the resilient device for a drum pedal in FIG. 1.
Figure 3:
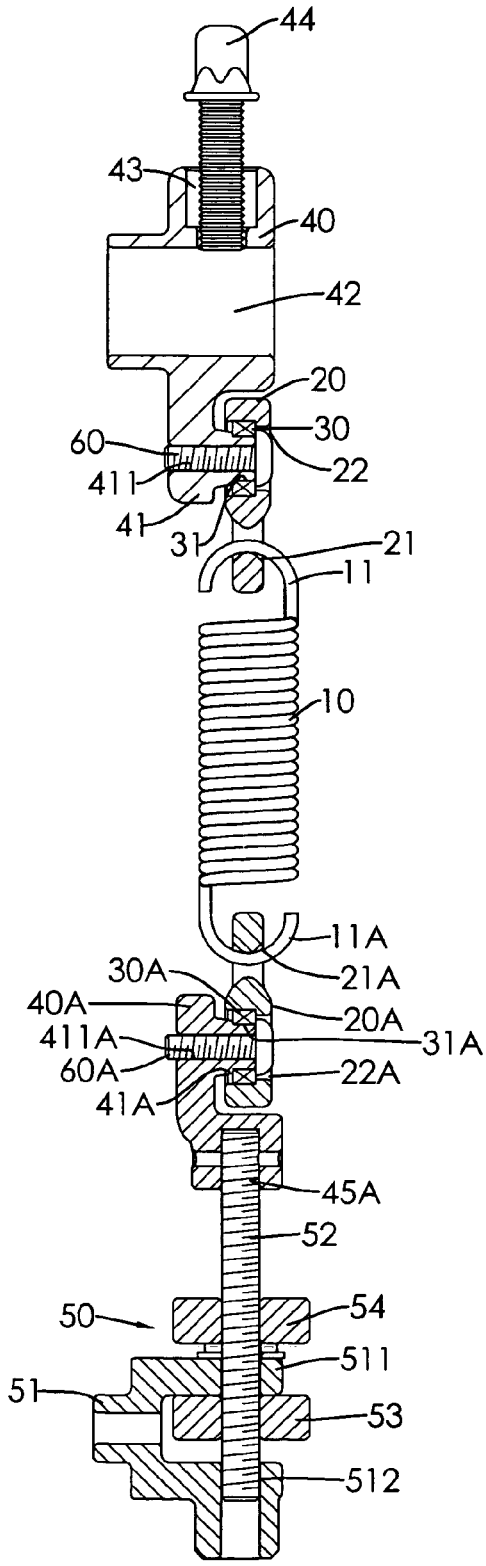
FIG. 3 is a side view in partial section of the resilient device for a drum pedal in FIG. 1.

With reference to FIGS. 1 to 3, a resilient device for a drum pedal in accordance with the present invention comprises a resilient member (10), an upper driven fastener (20), an upper bearing (30), a stationary fastener (40), a lower driven fastener (20A), a lower bearing (30A), a connecting fastener (40A) and an adjusting assembly (50).

The resilient member (10) has an upper hook (11) and a lower hook (11A) and the resilient member (10) may be a coil spring.

The upper driven fastener (20) is connected to the resilient member (10) and has an upper portion, a lower portion, an upper engagement hole (21) and an upper pivot hole (22). The upper engagement hole (21) is formed transversely through the lower portion of the upper driven fastener (20) and the upper hook (11) of the resilient member (10) engages the upper engagement hole (21). The upper pivot hole (22) is formed transversely through the upper portion of the upper driven fastener (20).

The upper bearing (30) is mounted in the upper pivot hole (22) of the upper driven fastener (20) and has a center hole (31).

The stationary fastener (40) is connected to the upper driven fastener (20) and has an upper portion, a lower portion, a positioning column (41), a through hole (42), a threaded hole (43) and a positioning screw (44). The positioning column (41) protrudes transversely from the lower portion of the stationary fastener (40) and is mounted through the center hole (31) of the upper bearing (30) and the upper pivot hole (22) of the upper driven fastener (20) and has a positioning hole (411). The upper bearing (30) is clamped between the stationary fastener (40) and the upper driven fastener (20). The through hole (42) is formed transversely through the upper portion of the stationary fastener (40). The threaded hole (43) is formed longitudinally through the upper portion of the stationary fastener (40) and communicates with the through hole (42). The positioning screw (44) is screwed into the threaded hole (43). A fastener (60) is mounted through the upper pivot hole (22) of the upper driven fastener (20), and then mounted in the positioning hole (411) of the stationary fastener (40) to connect the upper driven fastener (20), the upper bearing (30) and the stationary fastener (40) securely.

The lower driven fastener (20A) is connected to the resilient member (10) and has an upper portion, a lower portion, a lower engagement hole (21A) and a lower pivot hole (22A). The lower engagement hole (21A) is formed transversely through the upper portion of the lower driven fastener (20A) and the lower hook (11A) of the resilient member (10) engages the lower engagement hole (21A). The lower pivot hole (22A) is formed transversely through the lower portion of the lower driven fastener (20A).

The lower bearing (30A) is mounted in the lower pivot hole (22A) of the lower driven fastener (20A) and has a center hole (31A).

The connecting fastener (40A) is connected to the lower driven fastener (20A) and has an upper portion, a lower portion, a connecting column (41A) and a locating hole (45A). The connecting column (41A) protrudes transversely from the upper portion of the connecting fastener (40A) and is mounted through the center hole (31A) of the lower bearing (30A) and the lower pivot hole (22A) of the lower driven fastener (20A) and has a connecting hole (411A). The lower bearing (30A) is clamped between the connecting fastener (40A) and the lower driven fastener (20A). The locating hole (45A) is formed longitudinally through the lower portion of the connecting fastener (40A). A fastener (60A) is mounted through the lower pivot hole (22A) of the lower driven fastener (20A), and then mounted in the connecting hole (411A) of the connecting fastener (40A) to connect the lower driven fastener (20A), the lower bearing (30A) and the connecting fastener (40A) securely.

The adjusting assembly (50) is connected to the connecting fastener (40A) and has a joint seat (51), an adjusting screw (52), an adjusting nut (53) and a positioning nut (54). The joint seat (51) has two panels (511) being parallel to each other and each panel (511) has a mounting hole (512). The adjusting screw (52) is mounted through the mounting holes (512) of the joint seat (51) and has a top end mounted securely in the locating hole (45A) of the connecting fastener (40A). The adjusting nut (53) and the positioning nut (54) are separately screwed on the adjusting screw (52). The adjusting nut (53) is positioned between the panels (511) of the joint seat (51). The positioning nut (54) is positioned above the joint seat (51).

Figure 4:
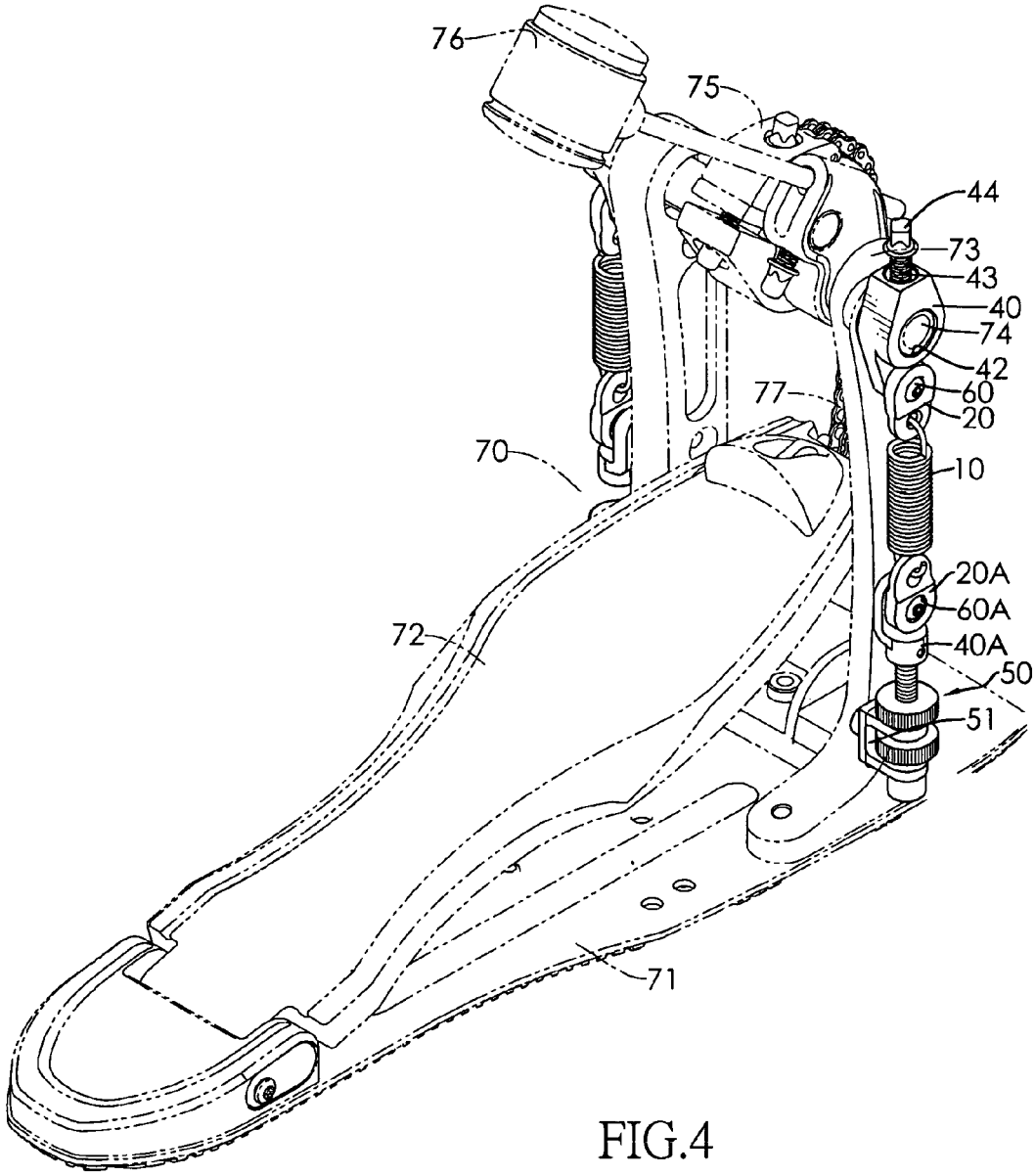
FIG. 4 is a perspective view of a drum pedal with the resilient device in FIG. 1.

With reference to FIG. 4, in a preferred embodiment, two resilient devices in accordance with the present invention are separately attached to sides of a drum pedal (70). The drum pedal (70) has a base (71) connected pivotally to a pedal body (72), two stands (73) protrude from the base (71), a driving shaft (74) is mounted pivotally between the top ends of the stands (73), a connecting seat (75) is mounted securely on the driving shaft (74), a drumstick (76) is connected to the connecting seat (75) and a chain (77) is connected between the pedal body (72) and the connecting seat (77). The through hole (42) of the stationary fastener (40) is mounted around the driving shaft (74) and the positioning screw (44) is screwed into the threaded hole (43) to fasten the driving shaft (74) and the stationary fastener (40). The joint seat (51) is mounted securely on the bottom end of the stand (73).

Figure 5:
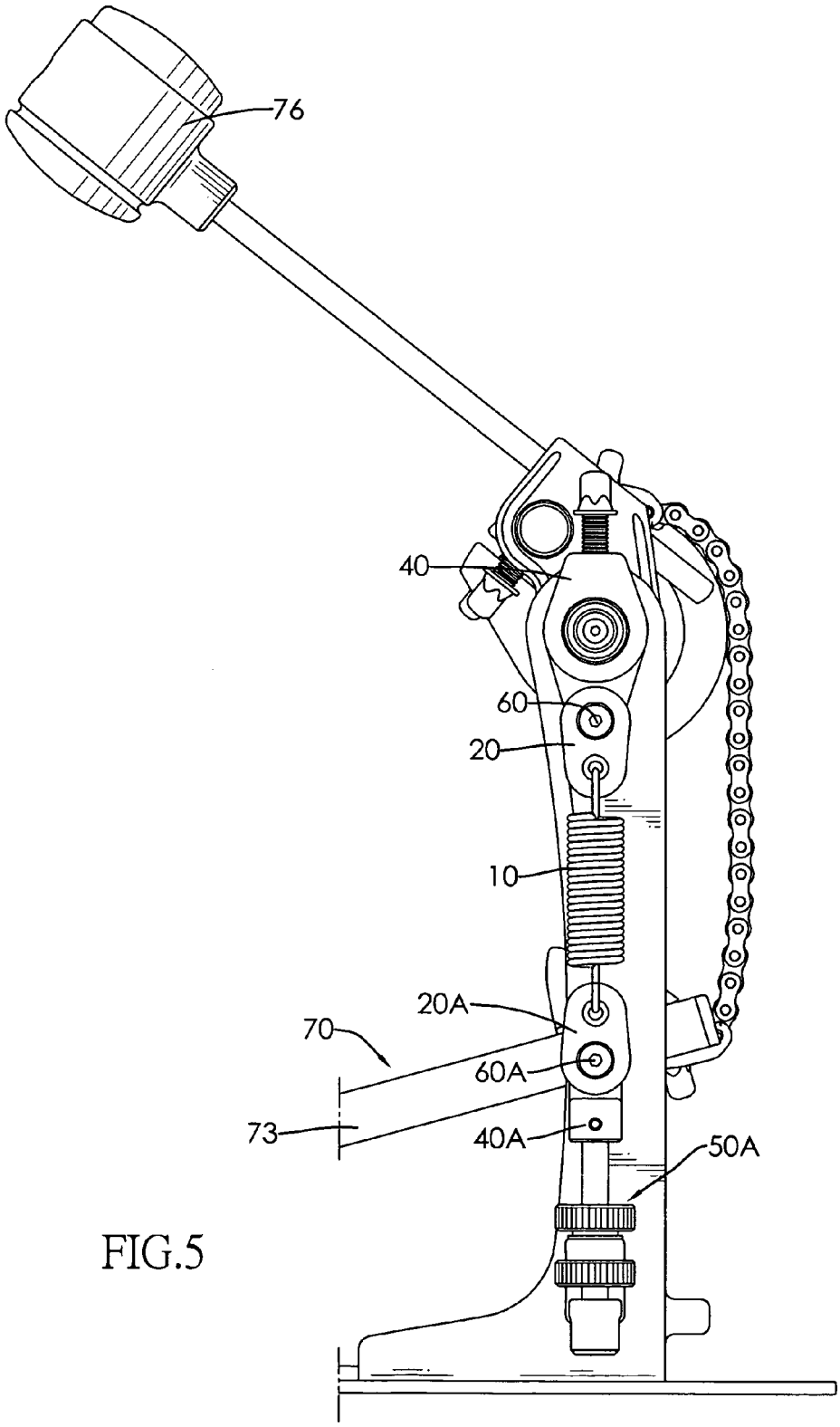
FIG. 5 is an enlarged side view of the drum pedal in FIG. 4.
Figure 6:
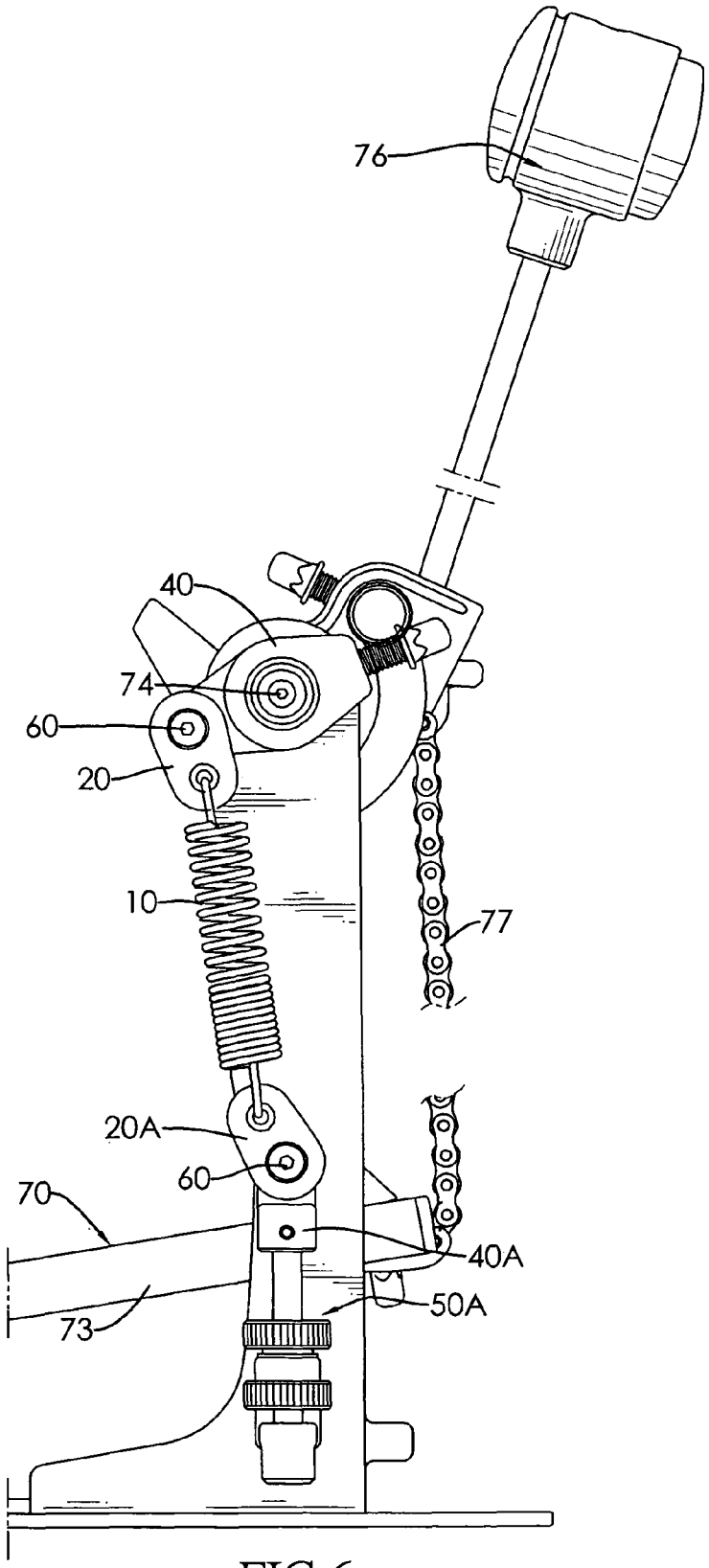
FIG. 6 is an operational enlarged side view of the drum pedal in FIG. 4, showing the drumstick pivoting.
Figure 7:
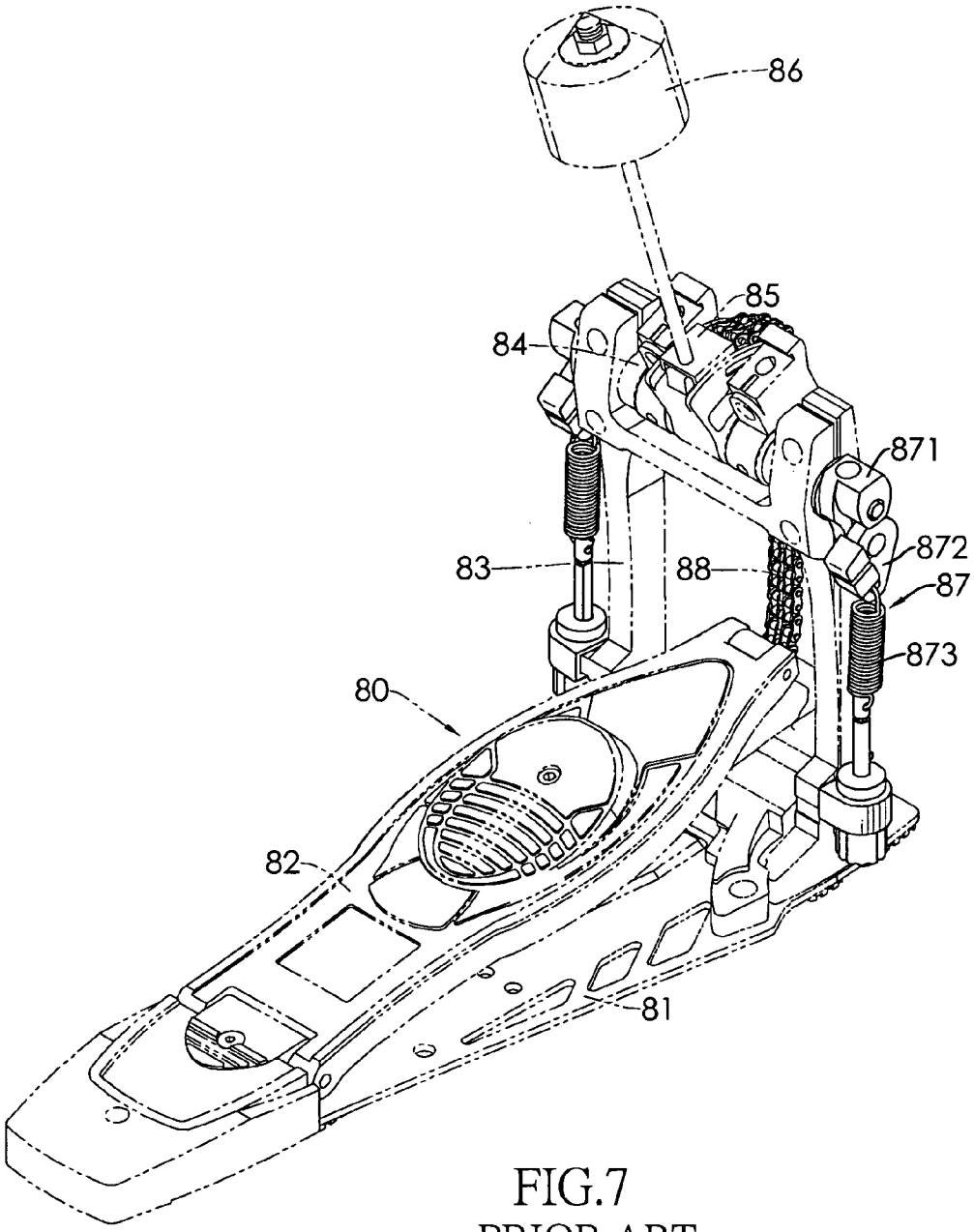
FIG.7 PRIOR ART
FIG. 7 is a perspective view of a conventional drum pedal in accordance with the prior art.

With reference to FIG. 5, when the pedal (73) is non-actuated, the drumstick (76) faces toward the pedal (73). With reference to FIG. 6, when the pedal (73) is pressed, the drumstick (76) is driven to rotate by the chain (77) and faces toward and sound a bass drum. Meanwhile, the stationary fastener (40) is driven to rotate and the upper driven fastener (20) is rotated and the resilient member (10) is stretched and stores a recoil force. Besides, the lower driven fastener (20A) is rotated synchronously. When the pedal (73) is released, the resilient member (10) provides the recoil force to pull the drumstick (76) away from the bass drum. Accordingly, the pedal body (72) is repeatedly pressed so the bass drum can be sounded continuously. The upper and lower bearings (30, 30A) allow the resilient member (10) to be stretched smoothly and friction between elements is decreased so moving the pedal body (72) is easier and smoother for greater control.

Moreover, the adjusting nut (53) can be adjusted and drives the adjusting screw (52) to move up and down so the tightness of the resilient member (10) can be adjusted. After the resilient member (10) is adjusted to a suitable tightness, screwing the positioning nut (54) secures the resilient member (10). Because a tightness of the resilient member (10) influences recoil of the drumstick (76), a drummer can control beats of the drumstick (76) and for greater control.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A resilient device for a drum pedal comprising:

a resilient member mounted between an upper driven fastener and a lower driven fastener, the upper driven fastener having an upper pivot hole and the lower driven fastener having an lower pivot hole;

an upper bearing mounted in the upper pivot hole of the upper driven fastener and having a center hole;

a stationary fastener connected pivotally to the upper driven fastener and having a positioning column mounted through the center hole of the upper bearing and the upper pivot hole of the upper driven fastener, the upper bearing clamped between the stationary fastener and the upper driven fastener;

a lower bearing mounted in the lower pivot hole of the lower driven fastener and having a center hole; and a connecting fastener connected pivotally to the lower driven fastener and having a connecting column mounted through the center hole of the lower bearing and the lower pivot hole of the lower driven fastener, the lower bearing clamped between the connecting fastener and the lower driven fastener.

2. The resilient device for a drum pedal as claimed in claim 1, wherein the resilient member has an upper hook and a lower hook;

the upper driven fastener has an upper engagement hole and the upper hook of the resilient member engages the upper engagement hole; and the lower driven fastener has a lower engagement hole and the lower hook of the resilient member engages the lower engagement hole.

3. The resilient device for a drum pedal as claimed in claim 1 further having an adjusting assembly having a joint seat having two panels and each panel having a mounting hole;

an adjusting screw mounted through the mounting holes of the joint seat and having a top end mounted securely on the connecting fastener; and an adjusting nut screwed on the adjusting screw and positioned between the panels of the joint seat.

4. The resilient device for a drum pedal as claimed in claim 1 further having an adjusting assembly having a joint seat having two panels and each panel having a mounting hole;

an adjusting screw mounted through the mounting holes of the joint seat and having a top end mounted securely on the connecting fastener; and an adjusting nut screwed on the adjusting screw and positioned between the panels of the joint seat.

5. The resilient device for a drum pedal as claimed in claim 2, wherein the adjusting assembly further has a positioning nut screwed on the adjusting screw and positioned above the joint seat.

6. The resilient device for a drum pedal as claimed in claim 5, wherein the adjusting assembly further has a positioning nut screwed on the adjusting screw and positioned above the joint seat.

* * * * *